US005933174A

United States Patent [19]

Kawazoe et al.

[11] Patent Number: 5,933,174

[45] Date of Patent: Aug. 3, 1999

[54] INK REFILLING SYSTEM, AND INK REFILLING APPARATUS AND INK REFILLING METHOD USABLE IN INK REFILLING SYSTEM

[75] Inventors: Kenji Kawazoe; Akira Miyakawa, both of Yokohama; Soichi Hiramatsu, Tokyo; Hideki Yamaguchi; Hiroyuki Inoue, both of Yokohama; Takashi Nojima, Tokyo; Tetsuya Ishikawa, Yokohama; Hitoshi Nakamura, Kawasaki; Akira Kida; Hideaki Kawakami, both of Yokohama, all of Japan

[73] Assignee: Canon Kabushiki Kaisha, Tokyo, Japan

[21] Appl. No.: 08/925,084

[22] Filed: Sep. 8, 1997

Related U.S. Application Data

[63] Continuation of application No. 08/355,015, Dec. 13, 1994.

[30] Foreign Application Priority Data

Dec. 13, 1993 [JP] Japan ..... 5-311550
Oct. 26, 1994 [JP] Japan ..... 6-262270

[51] Int. Cl.[6] ..... B41J 2/175

[52] U.S. Cl. ..... 347/85

[58] Field of Search ..... 347/85, 86, 87

[56] References Cited

U.S. PATENT DOCUMENTS

| | | | |
|---|---|---|---|
| 4,187,511 | 2/1980 | Robinson | 347/85 |
| 4,757,331 | 7/1988 | Mizusawa | 347/85 |
| 4,965,596 | 10/1990 | Nagoshi et al. | 347/86 |
| 5,138,343 | 8/1992 | Aichi et al. | 347/30 |
| 5,148,185 | 9/1992 | Abe et al. | 347/85 |
| 5,231,416 | 7/1993 | Terasawa et al. | 347/87 |
| 5,365,260 | 11/1994 | Kitani et al. | 347/87 |

FOREIGN PATENT DOCUMENTS

| | | | |
|---|---|---|---|
| 246040 | 11/1991 | Japan | 347/84 |

*Primary Examiner*—N. Le
*Assistant Examiner*—Michael Nghiem
*Attorney, Agent, or Firm*—Fitzpatrick, Cella, Harper & Scinto

[57] ABSTRACT

An ink refilling system includes an ink jet recording apparatus, in which a cartridge with an ink containing portion can be installed. The ink jet recording apparatus includes a driver for driving a conveyer for conveying a recording medium, and a first transmitter for transmitting the driving force from the driver out of the ink jet recording apparatus. Also provided is an ink filling apparatus for filling the ink into the cartridge, the ink filling apparatus including: an ink storing portion for storing the ink to be filled into the cartridge; a connector for injecting the ink from the ink storing portion to the cartridge; a pressure-feeding device for pressure-feeding the ink through the connector; and a second transmitter for transmitting the driving force to drive the pressure-feeding device. The driving force from the driver of the ink jet recording apparatus is transmitted to the pressure-feeding device through the first and second driving force transmitters.

4 Claims, 11 Drawing Sheets

(a)

(b)

(a)

(b)

(c)

INK REFILLING SYSTEM, AND INK REFILLING APPARATUS AND INK REFILLING METHOD USABLE IN INK REFILLING SYSTEM

This application is a continuation of application Ser. No. 08/355,015 filed Dec. 13, 1994.

FIELD OF THE INVENTION AND RELATED ART

The present invention relates to the topic of ink refilling, in particular, an ink refilling system for refilling ink into a cartridge that contains the ink and is used in an ink jet recording apparatus, and an ink filling apparatus and an ink refilling method, which are employed in the ink refilling system.

Recently, in the field of economy models of ink jet recording apparatus, a cartridge type ink jet unit has come to be popularly used. In the case of this type of cartridge, a recording head, and an ink cartridge (hereinafter, also called ink container) containing, in an ink absorbing member placed within the ink cartridge, the ink to be delivered to the recording head, are integrally joined to form the ink jet unit, which can be removably mounted on a carriage, and images are recorded as the carriage scans the recording medium. This ink jet unit is exchanged with a fresh one when the ink within the ink container is depleted.

However, since the service life of the recording head is rather long relative to the amount of the ink containable in the ink container of the ink jet unit, the ink head will be still in a very usable condition when the ink in the ink jet unit runs out. In other words, the ink jet is exchanged with a fresh one and discarded even though the recording head is still usable, which is not preferable from the viewpoint of preservation of natural resources and environmental protection.

Thus, proposals have been made to refill the ink into the ink container of such an ink jet unit. More specifically, there is one devised by Graphic Utilities Co. In this case, a syringe needle attached to a bellows type ink container is inserted through a hole cut through the ink container wall, and then, the bellows type ink container is gradually collapsed by hand so that the ink is refilled by the resulting pressure. In another ink container that has been developed the ink container is shaped like a syringe, and the ink is also refilled with the application of the pressure.

In the case of these types of ink refilling devices, a needle-like member is employed for injecting the ink, and therefore, there is the risk of accidentally hurting an operator. Further, when the ink is forced out of the needle faster than the speed at which the ink permeates the absorbing material, the ink is liable to overflow from the hole cut through the ink container. Further, in the case of the bellows type or syringe type ink container, the flow resistance is rather low before the needle is inserted; therefore, the ink is liable to leak out of the needle even when there is only a slight impact.

In addition, in order to refill the ink without causing the ink to overflow, it is necessary to maintain a predetermined pressure, which requires a complex structure. When means for maintaining the appropriate pressure is eliminated to simplify the structure, the proper pressure must be manually maintained while the ink is refilled; therefore, it is difficult to maintain the proper pressure, and also, the time the operator has to spend for the ink refilling operation is rather long.

SUMMARY OF THE INVENTION

The primary object of the present invention is to solve the above problems. Therefore, the present invention is characterized in that ink pressure-feeding means of an ink filling apparatus capable of refilling the ink into the ink container is driven by driving means that is provided within the ink jet recording apparatus and drives recording medium conveying means.

According to the present invention, an ink refilling system comprises: an ink jet recording apparatus, in which a head cartridge can be installed, the ink jet recording apparatus comprising driving means for driving conveying means for conveying a recording medium, and first transmitting means for transmitting the driving force from the driving means out of the ink jet recording apparatus; an ink filling apparatus for filling the ink into the cartridge, the ink filling apparatus comprising: an ink storing portion for storing the ink to be filled into the head cartridge; connecting means for injecting the ink from the ink storing portion to the head cartridge; pressure-feeding means for pressure-feeding the ink through the connecting means; and a second transmitting means for transmitting the driving force that drives the pressure-feeding means; wherein the driving force from the driving means of the ink jet recording apparatus is transmitted to the pressure-feeding means through the first and second driving force transmitting means.

According to an aspect of the present invention, an ink filling apparatus for filling ink into a head cartridge containing the ink, comprises: an ink storing portion for storing the ink to be filled into the head cartridge; connecting means for injecting the ink from the ink storing portion to the head cartridge; pressure-feeding means for pressure-feeding the ink through the connecting means; and driving force transmitting means for transmitting to the pressure-feeding means, the driving force that drives the pressure-feeding means; wherein the driving force transmitting means transmits the driving force from driving means that drives recording medium conveying means provided in an ink jet recording apparatus in which the cartridge can be installed According to another aspect of the present invention, an ink refilling method for refilling ink into a cartridge with an ink containing portion for containing the ink, comprises steps of: connecting the ink storing portion storing the ink to be refilled, to the ink containing portion of the cartridge; connecting a first transmitting mechanism for transmitting the driving force from driving means that drives conveying means of an ink jet recording apparatus in which the cartridge can be mounted, to a second transmitting mechanism for transmitting the driving force to pressure-feeding means that pressure-feeds the ink from the ink storing portion to the ink containing portion; and driving the pressure-feeding means to pressure-feed the ink.

The employment of the above structure and method can afford the elimination of the driving mechanism of the pressure-feeding apparatus that is to be provided within the ink filling apparatus in order to inject the ink; therefore, the structure of the ink filling apparatus can be simplified, and also, the ink can be stably injected into the cartridge.

Also, it is possible to provide an ink filling apparatus capable of filling the ink easily and inexpensively, and further, since it is easy to repeatedly use the head cartridge, the overall recording is reduced.

These and other objects, features and advantages of the present invention will become more apparent upon a consideration of the following description of the preferred embodiments of the present invention taken in conjunction with the accompanying drawings.

DETAILED DESCRIPTION OF THE PRFFERRED EMBODIMENTS

Below, embodiment examples of the present invention will be described with reference to drawings.

(EMBODIMENT 1)

Figure 1:
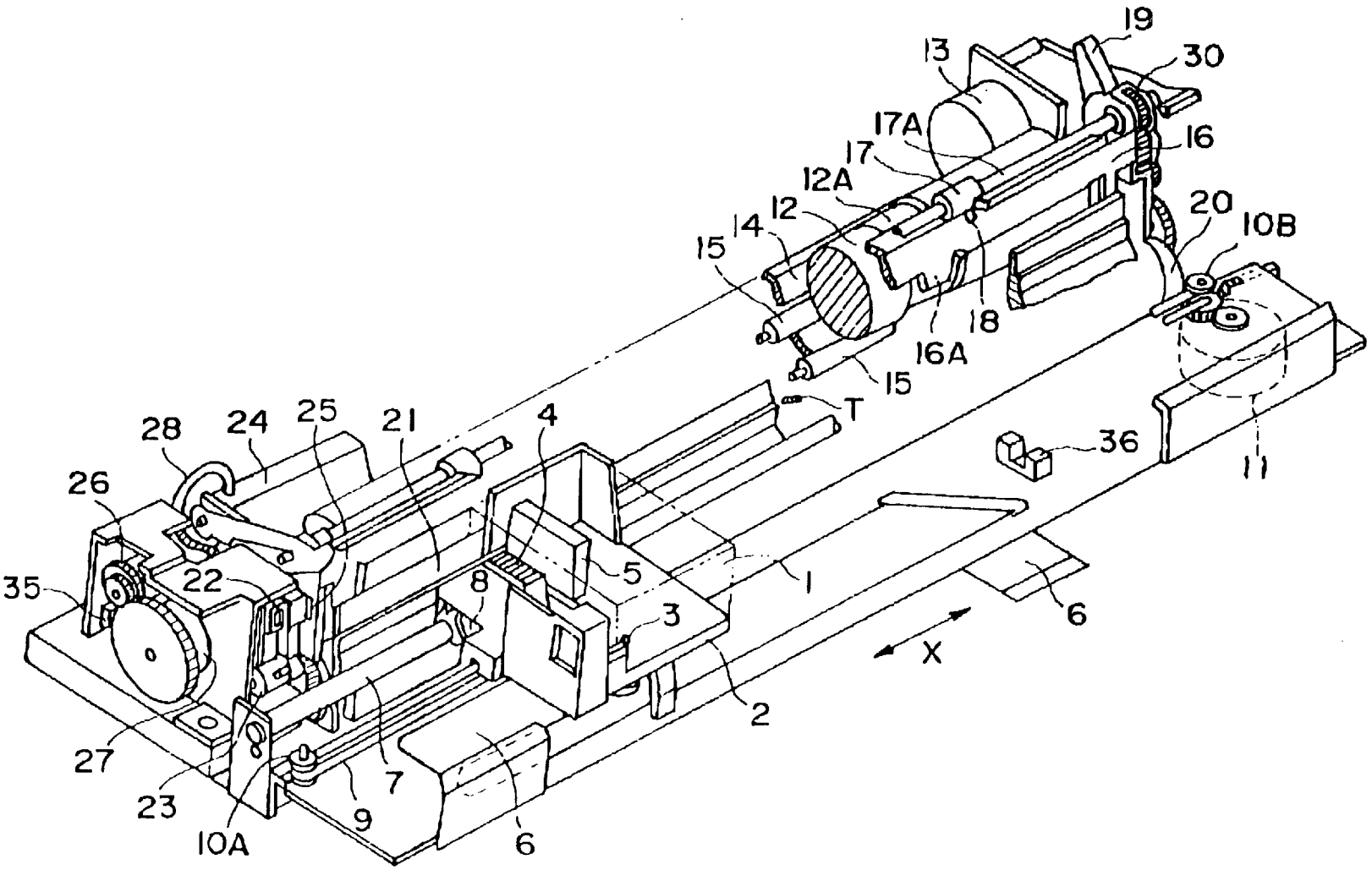
FIG. 1 is a schematic oblique view of a first embodiment example of the ink jet recording apparatus according to the present invention.

FIG. 1 is a detailed oblique view of an ink jet recording apparatus according to the present invention. A reference numeral 1 designates a head cartridge comprising an ink jet recording head; 2, denotes a carrier that carries the ink jet recording head and scans in the direction of an arrow X indicated in the drawing; 3, denotes a hook for attaching the head cartridge 1 to the carrier 2; 4, denotes a lever for operating the hook 3; 5, denotes a supporting plate for supporting an electrical junction for the head cartridge 1; and 6 designates an FPC (Flexible Printed Circuit) that connects the electrical junction and the control section of the apparatus main assembly.

A reference numeral 7 designates a guide shaft for guiding the carrier 2 in the X direction. The guide shaft 7 is put through and borne by a bearing 8. A reference numeral 9 designates a timing belt, which is connected to the carrier 2 and transmits to the carrier 2 the power for moving the carrier 9 in the X direction. The timing belt 2 is stretched between pulleys 10A and 10B placed at correspondent lateral ends of the apparatus. One of the pulleys 10B receives a driving force from a carrier motor 11 through a transmission mechanism such as a gear train. A reference numeral 12 is a conveyer roller that regulates the recording surface of recording medium such as paper and conveys the recording medium during a recording operation. It is driven by a conveyer motor 13, whereas a knob for conveying manually the recording medium is provided at one end of the conveyer roller 12.

A reference numeral 14 designates a paper pan for guiding the recording medium to a recording position; 15, denotes a pinch roller, which is disposed in the recording medium path to press the recording medium onto the conveyer roller 12 so that the recording medium is smoothly conveyed; and 16 designates a platen, which is positioned so as to face directly the ejection orifices of the head cartridge and regulates the recording surface of the recording medium.

A reference numeral 17 designates a sheet discharge roller, which is placed on the downstream side of the recording position, relative to the direction in which the recording medium is advanced, and discharges the recording medium toward an unillustrated discharge opening. At one end of this discharge roller 17, a gear 30 is attached, which transmits the driving force from the conveyer roller 12 to the sheet discharging roller 17, and also drives an ink filling apparatus, which will be described later.

A reference numeral 18 designates a spur, which is disposed so as to press on the discharge roller 17 through the recording medium, so that the recording medium is conveyed by the force from the discharge roller 17. A reference numeral 19 designates a release lever, which releases the pressure from the pinch roller 15 and spur 18 at the time when the recording medium is set in the apparatus or on a like occasion.

The platen 16 is rotatively supported at each end by the axle of the discharge roller 17, being urged from the direction of the stopping position of the left and right plates 20 toward the front portion of the paper pan 14. It is also provided with two or more tab-like portions 16A, the locations of which correspond to the conveyer roller 12 portions, of which the diameter is rendered smaller than the diameter of the outermost circumference of the conveyer roller 12. These tab-like portions 16A contact the interior side of the front portion 21 of the paper pan.

A reference numeral 22 designates a cap, which is made of elastic material such as rubber and is disposed so as to face the recording head, being supported in such a manner that when the recording head is at the home position, it is allowed to come in contact with, or move away from, the recording head surface, on which the ink ejection orifices are located. It protects the recording head, during the non-recording period, and also, it is used when a head performance recovery procedure (head recovery operation) is carried out for the recording head.

Here, the head recovery operation means a recovery operation by ejection (preliminary ejection), that is, an operation in which energy generating elements, which are disposed within the ink ejection orifices and generate the energy for ejecting the ink, are all driven to eject the ink from all of the ink ejection orifices, so that the sources of faulty ejection, such as bubbles, dust, and/or the ink having become unsuitable for recording due to increased viscosity, are eliminated; or a recovery operation by suction, that is, an operation in which the internal pressure of the cap 22 is decreased with the cap 22 covering the ejection orifice surface so that the ink is sucked out of the ejection orifices to eliminate above sources of faulty ejection.

A reference numeral 23 is a pump, which is used to suck the ink received in the cap 22 during the recovery-by-suction procedure that sucks the ink out of the ejection orifices, or the recovery-by-ejection procedure that preliminarily ejects the ink, and 24 designates a waste ink storage container for storing the waste ink sucked in by the pump 23. The waste ink container 24 is connected to the pump 23 with a tube 28.

A reference numeral 25 designates a blade for wiping the ejection orifice surface of the recording head. It is movably supported so that it can move between a position at which it is projected toward the recording head and wipes the ejection orifice surface as the carrier moves, and another position (home position) to which it retreats so that it does not contact the ejection orifice surface. A reference numeral 26 designates a motor, and 27 designates a cam mechanism, through which the power from the motor 26 is transmitted to drive the pump 23 and move the cup 22 and blade 25.

A reference character T designates a temperature sensor for detecting the internal temperature (ambient temperature) of the recording apparatus. This temperature sensor 5 may be any known thermistor capable of outputting a voltage corresponding to a temperature change, and its output signal is inputted to an MPU 1000, which will be described later, by way of a predetermined signal amplifier circuit or the like.

Figure 2:
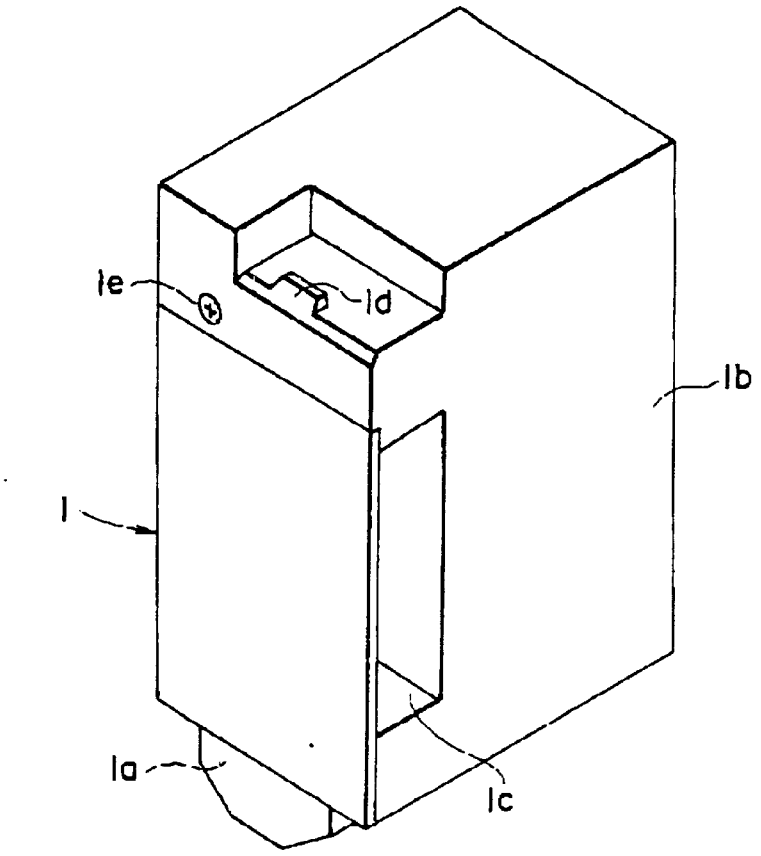
FIG. 2 is a schematic oblique view of a typical head cartridge that can be installed into the ink jet recording apparatus illustrated in FIG. 1.

FIG. 2 is a schematic oblique view of an example of head cartridge mountable on the carrier 2 of the ink jet recording apparatus illustrated in FIG. 1. This embodiment example employs a single piece head cartridge 1, in which an ejection unit 1*a* constituting the main structure of the ink jet recording head, and an ink container 1*b* constituting an ink containing portion for containing the recording ink, are integrated.

In FIG. 2, an alphanumeric reference 1*d* designates a claw, which engages a hook 3 provided on the carrier 2, when the head cartridge is installed. Here, the claw 1*d* is within extensions of the outer peripheries of the recording head.

An alphanumerical reference 1*c* is a head opening, which is provided on the carrier 2, and to which the flexible board (electric junction) and the support plate for supporting a rubber pad are inserted. An alphanumeric reference 1*e* designates an air vent, which is provided on the lid portion.

Figure 3:
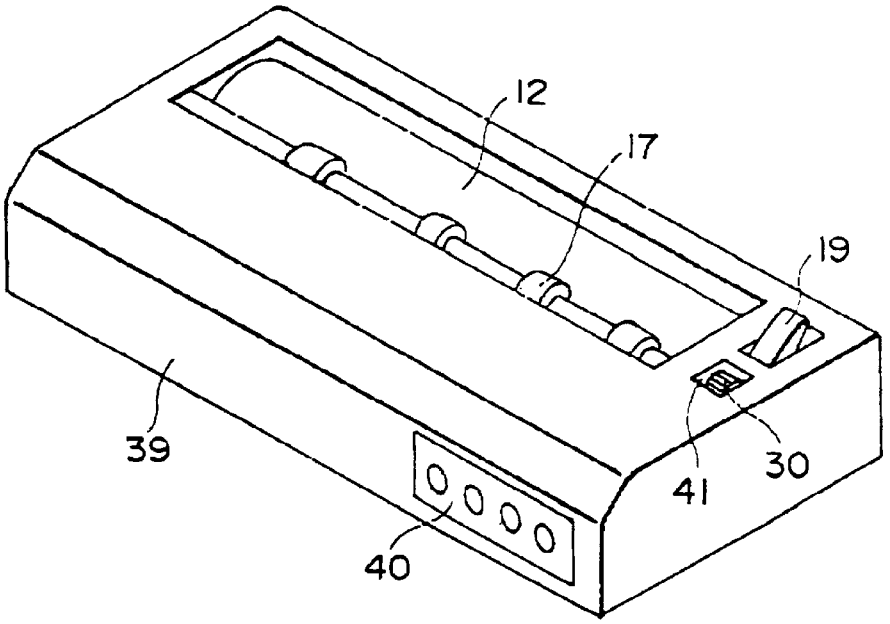
FIG. 3 is an oblique external view of the ink jet recording apparatus according to the present invention.

FIG. 3 is a schematic oblique view of the ink jet recording apparatus illustrated in FIG. 1, being covered with an exterior case 39. A power switch, and a control panel 40 for inputting various commands, are mounted on this exterior case 39. Also, the exterior case 39 is provided with an opening 41, which enables the gear 30 attached to the end of the sheet discharge roller 17 to engage with an external device.

Figure 4:
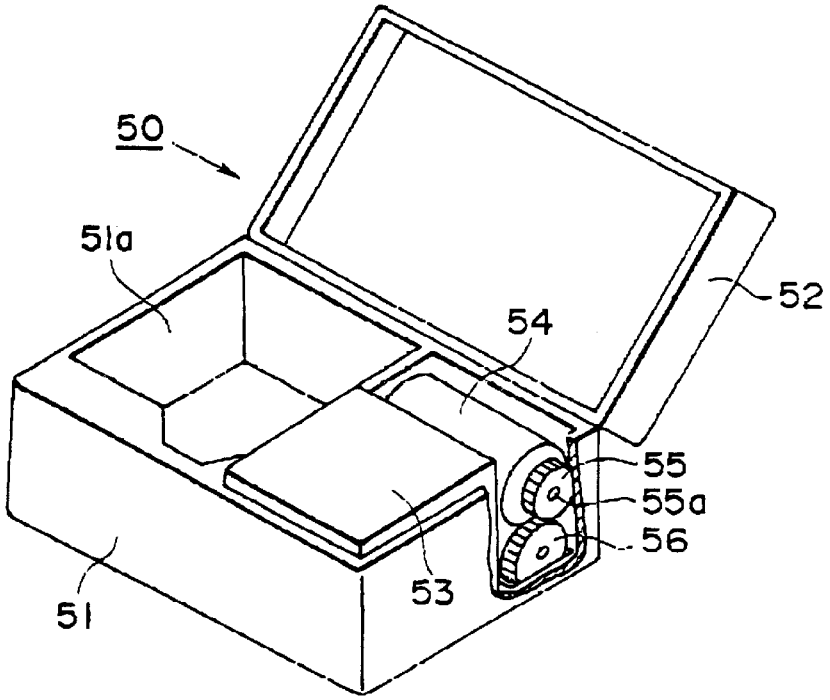
FIG. 4 is a schematic oblique view of an ink filling apparatus according to the present invention.

FIG. 4 is an oblique view of an ink filling apparatus according to the present invention. In FIG. 4, an ink filling apparatus 50 comprises a bottom case 51 and top case 52. The bottom case 52 is provided with an opening 51*a*, to which a recording head 1 to be filled with the ink is connected.

Also, an ink container 53, which stores the ink to be filled into the above head cartridge 1, is removably disposed in the bottom case. A reference numeral 54 designates a pump for supplying the ink from the ink container 53 to the head cartridge 1. The pump 54 can be connected to an air vent 1*e* provided on the head cartridge 1 with the use of an unillustrated tube.

Figure 13:
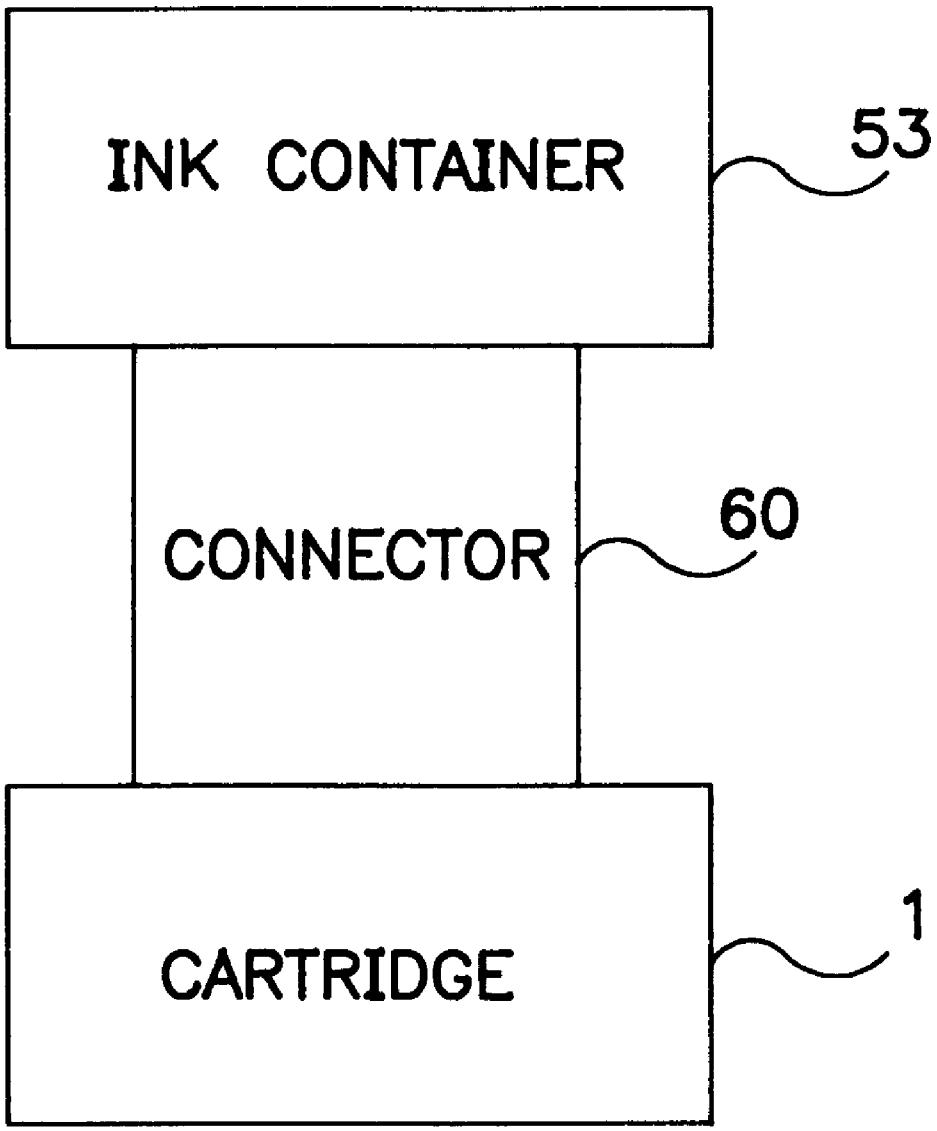
FIG. 13 is a schematic view of a connector connecting an ink container to an ink container to an ink cartridge.

In this embodiment example, the air vent 1*e* is also used as an ink filling opening, but an ink filling opening dedicated to supply the ink into the ink container 1*b* within the head cartridge may be provided with the use of a known means. For example, as shown in FIG. 13 a connector 60 injects the ink from the ink container 53 to the cartridge 1.

A reference numeral 55 designates a gear for driving the pump, and 56 designates a gear that meshes with the gear 30 provided within the recording apparatus and transmits the driving force from the recording apparatus.

Figure 5:
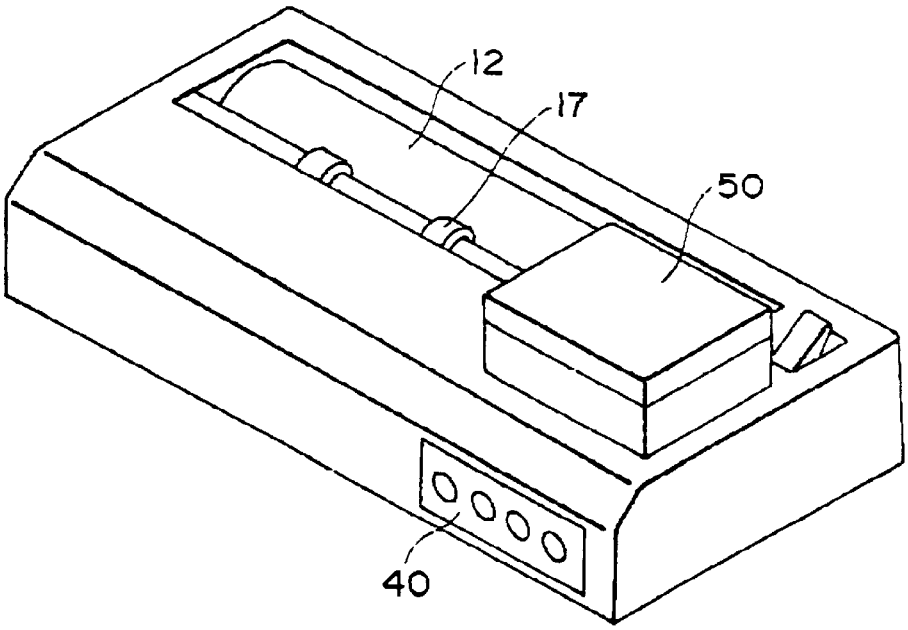
FIG. 5 is an oblique view depicting how the ink filling apparatus and ink jet recording apparatus according to the present invention are connected.

Referring to FIG. 5, this ink filling apparatus 50 is disposed on the recording apparatus, being engaged therewith by an unillustrated engaging means so that the gear 55 within the ink filling apparatus meshes with the gear 30 within the recording apparatus as described above.

Figure 6:
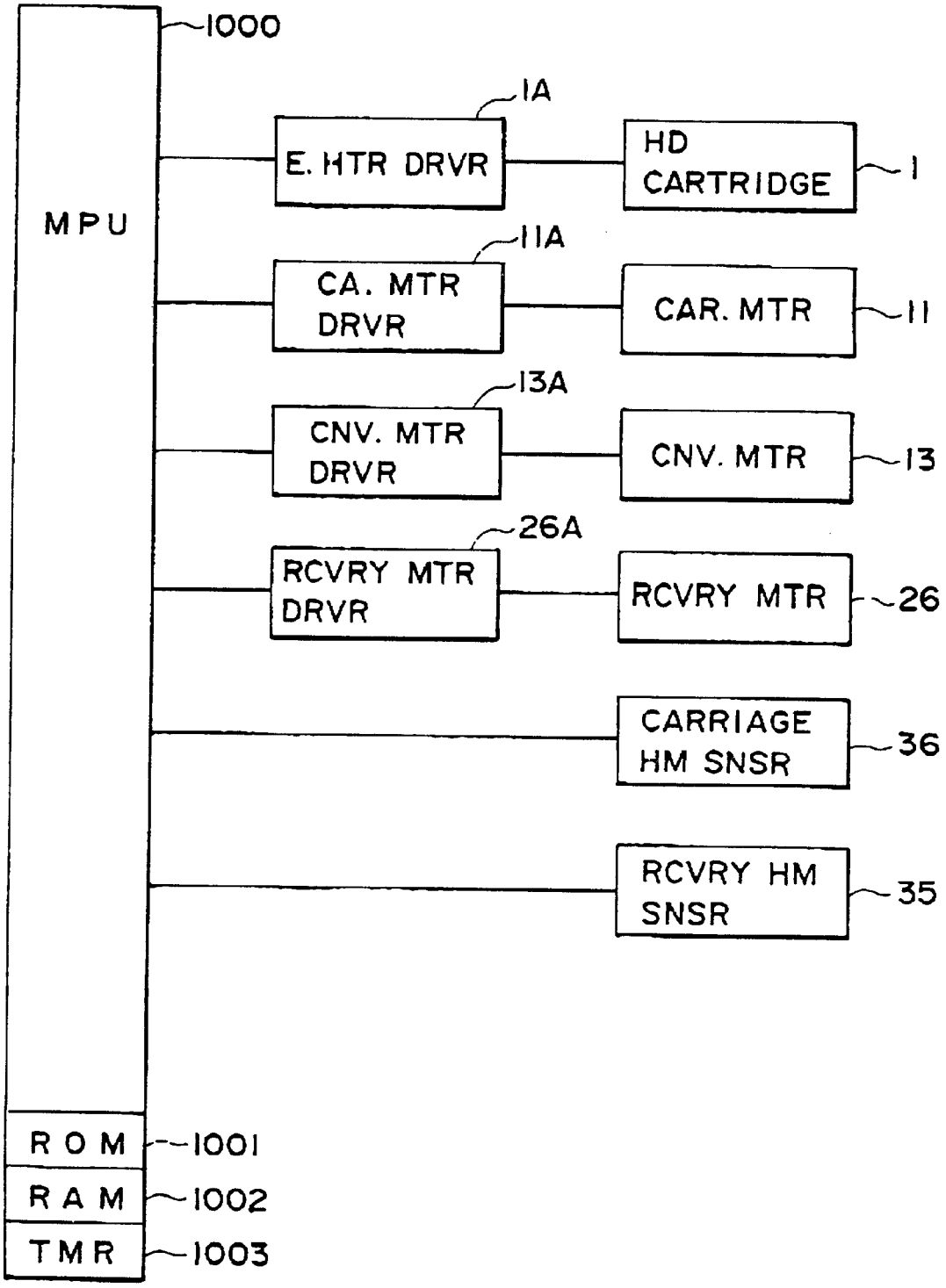
FIG. 6 is a block diagram of an example of the control system of the ink jet recording apparatus according to the present invention.

FIG. 6 is a block diagram of a typical structure of the control system of the ink jet recording apparatus according to the present invention. In FIG. 6, a reference numeral 1000 designates an MPU that executes preset control sequences such as a program or the like in order to control each section of the apparatus. This MPU 1000 is a single piece chip MPU comprising: a ROM 1001 that stores the programs or the like for the corresponding controlling means; a RAM 1002 that is used as a working area or the like when the control sequences are executed; and a built-in timer 1003 for providing the timing for the execution of the control sequences.

Among the structural components, those controlled by the MPU 1000 are the head cartridge (recording head) 1, the carrier motor 11, the conveyer motor 13, and the recovery system motor 26. The head cartridge 1 is driven by an ejection heater driver 1A. The carrier motor 11, the conveyer motor 1, and the recovery system motor 26 are driven by motor drivers 11A, 13A, and 26A, respectively. The MPU 1000 recognizes the location where the cap 22 is, or where the carrier 2 is moving on the basis of the detection output from a recovery system home sensor 35 and a carrier home sensor 36.

Next, referring to FIG. 7, an operation will be described with reference to the flow chart.

In a step S1, as the MPU determines that an recording command has been received, a recording step S2 follows, in which the ejection heater driver begins to drive the head cartridge, starting thereby to record images, in response to a command from the MPU. While the recording continues, the MPU keeps the count of the recorded dots (step S3).

In step S4, it is determine whether or not the recording dot count has come to satisfy: $N \geqq X$, wherein N stands for the recorded dot count, and X stands for the recordable dot count.

Here, it should be noted that the actual amount of the usable ink contained in the head cartridge 1 varies from cartridge to cartridge. Therefore, in this embodiment, the ink supplying timing for the head cartridge 1 is estimated on the basis of the dot count (X) calculated from the amount of the ink supply that can assure stable ink delivery.

In the step S4, when it is determined: $N \geqq X$, a step S5 is follows, in which an "out-of-ink message" is displayed. As for the determination timing in the step S4, it is optional, except for one condition that it is immediately after the completion of each page being then printed, since the ink refilling apparatus is driven by the conveyer motor. The message is displayed after the recording medium is completely discharged from the ink jet recording apparatus.

Then, in a step S6, the head cartridge 1, from which a predetermined amount of the ink has been consumed, is installed into the ink refilling apparatus, and next, this ink refilling apparatus is connected to the ink jet recording apparatus.

In a step S7, the MPU determines that the ink refilling operation has started, and then, steps S8 and S9 follow, in which the conveyer motor is driven in response to the commands from the MPU.

In the step S8, the conveyer motor 13 is rotated forward by a predetermined amount to deliver the ink from the ink container 53 of the ink filling apparatus to the pump 54.

Then, in the step S9, the conveyer motor 13 is rotated backward by a predetermined amount, whereby the ink stored in the pump 54 is filled into the ink container 1*b* of the head cartridge 1.

Since a single operation of the pump 1 is not enough to fill up the ink cartridge 1*b* of the recording head 1, the steps S8 and S9 have to be repeated twice or more times; therefore, the number of the pump 1 operation is counted as an ink refilling count (M) in a step S10.

Next, in step S11, it is determined whether the filling count M equals a pump drive count Y1, that is, the number of the pump operations needed for filling the ink by an amount sufficient to enable the recording head to eject the ink by the amount equivalent to the above recordable dot count X, and when the amount of the ink filled in the head cartridge becomes substantially equal to the amount of the initially filled ink, the ink refilling operation ends (step S12).

It is preferable that the pump drive count Y is calculated on the basis of the last value of the recording dot count N, and the resultant pump drive count Y of such a calculation is used to fill the ink by the amount equal to the initial amount.

The employment of the ink refilling system of this embodiment makes it unnecessary to provide the ink refilling apparatus with a motor or the like, which can afford a reduction in the component count of the ink refilling apparatus. Further, the driving force from the conveyer motor of the ink jet recording apparatus can be transmitted to the ink refilling apparatus, without using an uncommon gear structure; therefore, it is possible to provide an ink refilling system with an uncomplicated structure.

Further, the dot counting system for preventing the dry ejection can be used as an overfill prevention system during the ink refilling operation, which can also afford simplification of the apparatus.

Further, the ink refilling apparatus is removable from the ink jet recording apparatus; in other words, it can be stored away from the ink jet recording apparatus except when the ink refilling operation is carried out, and therefore, the space necessary for normal usage of the apparatus can be reduced. In addition, the ink refilling apparatus is mounted right above the ink jet recording apparatus, which means that the space to be occupied by the mounted ink refilling apparatus is substantially a portion of the space provided for making it easier to manipulate the recording medium. Therefore, in practical terms, no additional space is necessary for the ink refilling apparatus.

Also in this embodiment, the conveyer motor 13 is used to drive the ink filling apparatus. This is because when the carrier driving carrier motor 11 is used, torque strong enough to drive the pump of the ink refilling apparatus cannot be obtained.

However, when an independent motor is provided for driving the pump for the recovery operation, this motor may be used to drive the pump of the ink refilling apparatus. Evidently, the necessary torque can be obtained from this motor, since this motor is capable of driving the pump for the recovery operation.

As for another alternative driving power source, the driving motor for an automatic sheet feeding apparatus or the like may be used to obtain the same result.

(EMBODIMENT 2)

In the above first embodiment, the ink is refilled after it is determined that the amount of the remaining ink in the recording head 1 has reached the level below which the recording operation cannot be continued. In this embodiment example, a different case will be described, in which the ink fills the head cartridge 1 which does not yet need the ink to continue recording.

Figure 8:
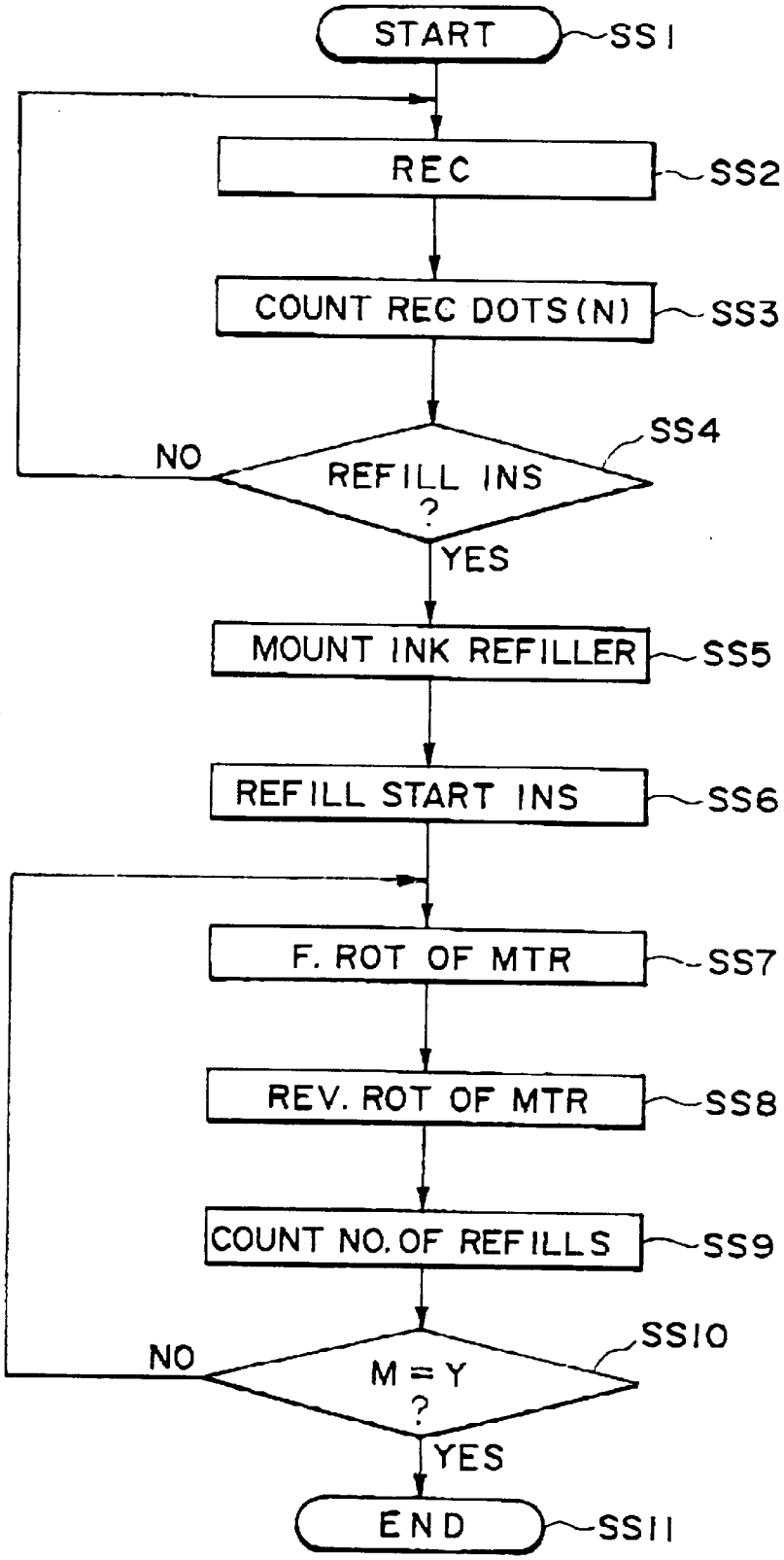
FIG. 8 a flow chart of an operational sequence for the second example of the embodiment of the ink refilling system according to the present invention.

Referring to a flow chart given in FIG. 8, the ink refilling method of this embodiment will be described. Here, it should be noted that the structural configuration of the ink refilling system of this embodiment is the same as that of the above first embodiment example, except for the following sequence.

In a step SS1, when the MPU determines that a recording command has been received, the sequence advances to a step SS2, in which the ejection heater driver begins to drive the head cartridge in response to the instruction from the MPU, starting thereby the recording operation. While the recording is going on, the MPU counts the number of the recorded dots (step SS3).

The amount of the ink consumed for the recording can be easily calculated from this number N of the recorded dots, and this number N of the recorded dots is stored in a non-volatile RAM or the like, as a recorded dot count N.

Figure 7:
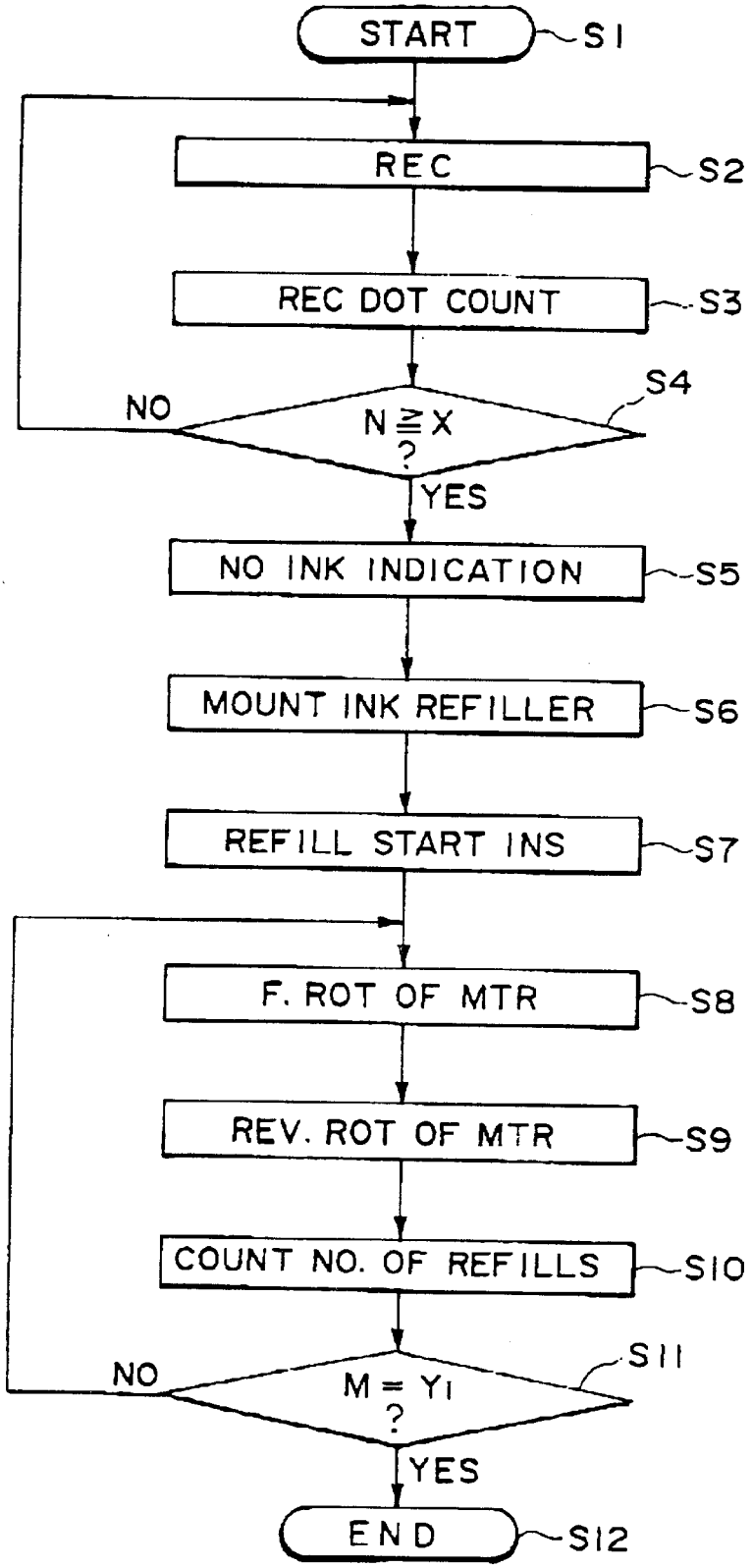
FIG. 7 is a flow chart of an operational sequence for the first example of the embodiment of the ink refilling system according to the present invention.

Up to this point, the sequence is the same as the one in FIG. 7.

Next, when the MPU receives an ink refilling command (step SS4) even though the recorded dot count has not reached the recordable dot count as in the step S4 in FIG. 7, that is, even though a sufficient amount of the ink remains in the head cartridge 1, a step SS5 follows.

In the step SS5, the head cartridge 1, from which a certain amount of the ink has been consumed, is mounted in the ink refilling apparatus, and this ink refilling apparatus is mounted on the ink jet recording apparatus.

Then, in a step SS6, the MPU determines that the ink refilling operation has begun, and steps SS7 and SS8 follow, in which the conveyor motor driver 13A drives the conveyor motor in response to the instruction from the MPU.

In the step SS7, the conveyor motor 13 is rotated forward by a predetermined amount to deliver the ink from the ink container 53 of the above ink filling apparatus to the pump 54.

Next, in the step SS8, the conveyor motor 13 is rotated backward by a predetermined amount, whereby the ink stored in the pump 54 is filled into the ink container 1*b* of the head cartridge.

At this point, since a single pump operation is not sufficient to fill up the ink container 1*b* of the recording head 1, it is necessary to repeat twice or more the operation carried out in the steps SS7 and SS8, and in step SS9 and the number of the pump operations is counted as an ink refilling count (M).

The steps SS5–SS9 are not different from those in the first embodiment example, except for the determination of the number of times the operations in the steps SS7 and SS8 need to be repeated. In the above first embodiment example, the referential count Y for ending the filling operation is the number of the pump operations necessary to fill the ink by the amount equivalent to the recordable dot count X, whereas in this embodiment, the number of the pump operations necessary to fill the ink by the amount equivalent to the ink consumption estimated on the basis of the above recorded dot count N is used as the referential count Y for ending the filling operation.

Next, in step SS10, it is determined whether or not the ink filling count (M) matches the referential count Y for ending the ink filling operation, and when it is determined that the amount of the ink refilled in the head cartridge 1 becomes substantially the same as the amount of the initially filled ink, the ink refilling operation ends (step SS11) .

According to the above sequence, even before a scheduled exchange of the head cartridge 1 is prompted, the head cartridge 1 can be refilled to the same ink level as that of the initially filled ink, without causing ink overflow or the like.

(EMBODIMENT 3)

In both of the preceding embodiment examples, the ink is filled while the recording operation is not going on. In this embodiment example, a structure that makes it possible to fill the ink even during the recording operation will be described.

Figure 9:
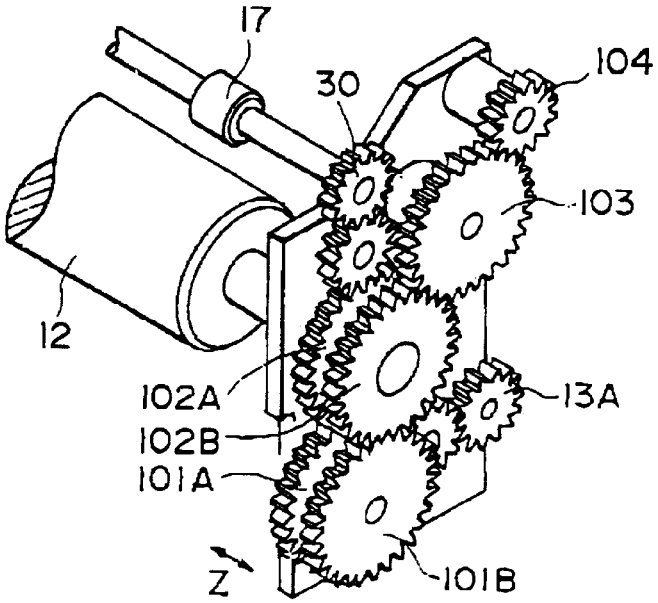
FIGS. 9 (*a*) and 9 (*b*) are schematic oblique views of an example of the gear train of a third example of the embodiment of the ink jet recording apparatus according to the present invention.
Figure 9:
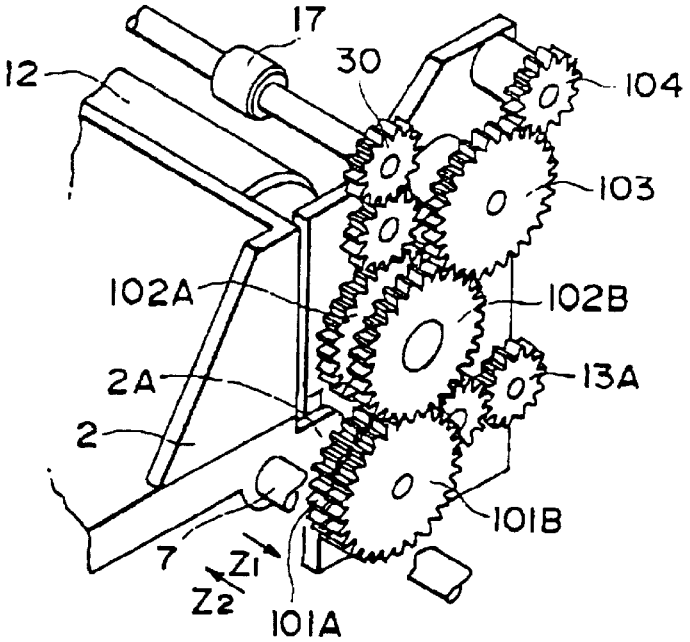

FIG. 9 (*a*) and 9 (*b*) illustrate a driving force transmission mechanism according to the present invention. In a mechanism shown in FIG. 9 (*a*), the driving force from the conveyor motor 13 is transmitted to the gear 30 through a trigger gear 101A and an LF (Line Feed) gear 102A. The LF gear 102A and gear 30 are fixed to the axle of the conveyor roller 12 and the axle of the discharge roller 17, respectively, and the driving force of the conveyor motor 13 is transmitted to the conveyor roller 12 and discharge roller 17 by way of these axles, respectively.

The trigger gear 101B rotates, through the LF gear 102B and gear 103, a gear 104 that transmits the driving force to the ink filling apparatus. The LF gear 102B is not fixed to the conveyor roller 12; therefore, the conveyor roller 12 cannot be rotated by the LF gear 102B.

The trigger gear 101A is movable on its axle in the direction of an arrow Z in the drawing, and the trigger gears 101A and 101B are disposed right next to each other, wherein an unillustrated elastic member is interposed between the two gears, pressuring them apart.

The mutually facing surfaces of the trigger gears 101A and 101B are provided with a toothed profile. When the trigger gear 101A is moved in the Z1 direction as shown in FIG. 9 (*b*), that is, when the trigger gear 101A is moved to the trigger gear 101B, they engage each other, whereby the driving force from the conveyor motor 13 is transmitted to the trigger gear 101B.

As for this movement of the trigger gear 101A in the Z1 direction, it is effected by a projection 2A provided on the carrier 2 shown in FIG. 9 (*b*). Therefore, a state illustrated in FIG. 9 (*a*), in which the conveyor roller 12 and discharge roller 17 are driven by the conveyor motor to convey normally the recording medium, can be switched to another state illustrated in FIG. 9 (*b*), in which the driving force is transmitted to the ink refilling apparatus, by the movement of the carrier 2.

Further, a locking mechanism (unillustrated) may be provided to lock the trigger gear 101A at the location where it engages with the trigger gear 101B, so that while the carrier 2 is scanning the recording medium to print the image equivalent to a single line, the trigger gears 101A and 101B are caused to remain engaged to transmit the driving force from the conveyor motor to drive the ink filling pump, and then, after one line of printing is completed, they can be disengaged. With this setup, the ink refilling apparatus can be driven even during the recording operation, though the drive is admittedly intermittent. In this case, the timing, with which the ink is refilled during the recording scan, is not limited to the above timing. Instead, it may be optionally set up to satisfy the user's needs. As for the locking mechanism, it is of a known type.

The employment of the ink refilling system of this embodiment example can afford the elimination of the motor or the like within the ink refilling apparatus; in other words, the component count can be reduced as in the case of the first embodiment example. It also makes it possible to fill the ink even during the recording operation; therefore, it is unnecessary to interrupt an on-going continuous printing operation just to fill the ink into the ink depleted head cartridge 1, minimizing thereby the overall time the user must spend for the printing operation.

(EMBODIMENT 4)

In the preceding embodiment examples, the conveyor motor and recovery operation motor are separate motors, whereas in this embodiment example, another ink refilling system will be described in which these motors are replaced with a single motor, the conveyor motor. A gear mechanism capable of realizing such an ink refilling system is illustrated in FIG. 10.

Figure 10:
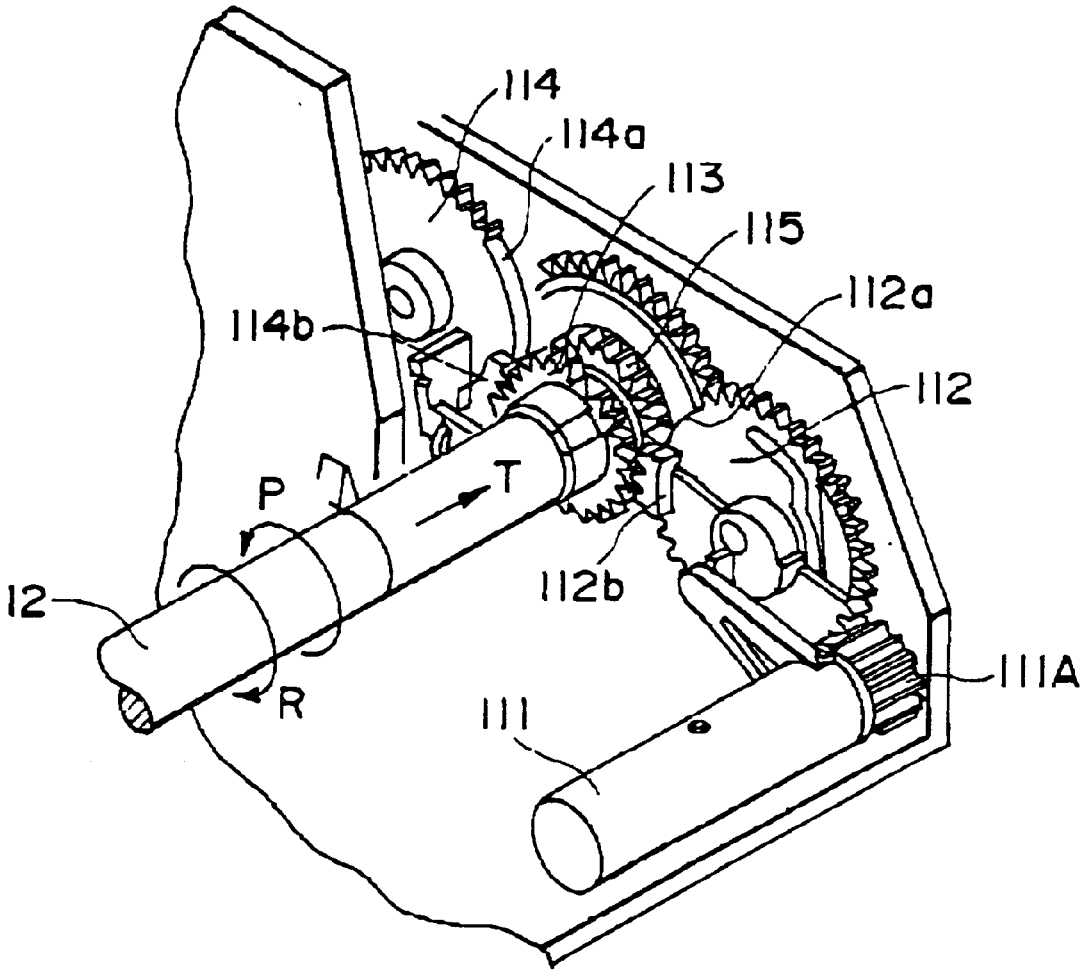
FIG. 10 is a schematic oblique view of an example of the gear train of a fourth example of the embodiment of the ink jet recording apparatus according to the present invention.

In FIG. 10, an LF gear 115 is fixed to one end of the conveyor roller 12, and this LF gear 115 is driven by an unillustrated gear and the conveyor motor.

Further, the conveyor roller 12 is provided with a trigger gear 113, which is mounted on the same axle as the conveyor roller 12, but is not fixed thereto, being movable by an unillustrated carrier in the direction of an arrow T in the drawing.

This embodiment example is the same as those described above in that the mutually facing surfaces of the trigger gears 113 and LF gear 115 are given a toothed profile, and when the trigger gear 113 is moved in the T direction, it engages with the LF gear 115, and also, in that an elastic member made of a spring or the like is disposed between the trigger gear 113 and LF gear 115 so as to pressure the two gears apart.

A reference numeral 111 designates a pump for carrying out the head recovery operation or the like, and 111A designates a gear for transmitting the driving force to a piston within the pump 111.

A reference numeral 112 designates a pump gear for transmitting the driving force to the pump 111, and meshes with the gear 111A. This pump gear 112 has a toothless portion 112*a*, and a sub-gear portion 112*b*, that is, the toothed portion that is displaced in the direction of the gear thickness. The sub-gear portion 112*b* meshes with the trigger gear 113, and the toothless portion 112*a* faces the teeth of the LF gear 115.

A reference numeral 114 designates a refill gear for transmitting the driving force to the ink filling apparatus. It also has a toothless portion 114*a* and a sub-gear portion 114*b*, which are disposed in such a manner that the pump gear 112 and refill gear 114 form a symmetrical arrangement with respect to the conveyor roller.

The sub-gears 112*b* and 114*b* are given a sufficient thickness so that even after the trigger gear 113 moves in the T direction in the drawing, they can remain engaged with the trigger gear 113.

Figure 11:
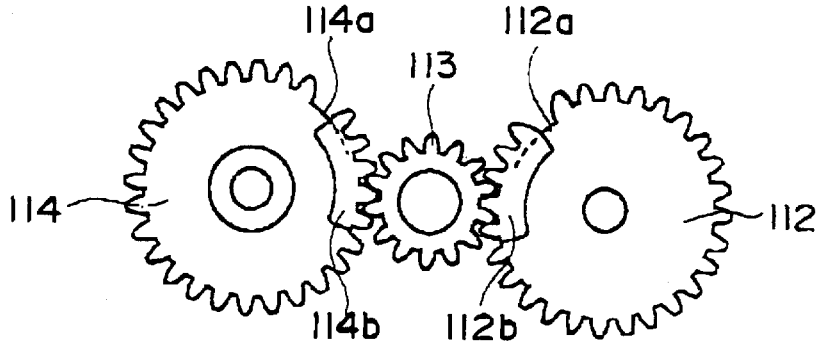
FIG. 11 (*a*) through 11 (*c*) are schematic views depicting how the gears of the gear train illustrated in FIG. 10 mesh with each other in each step.
Figure 11:
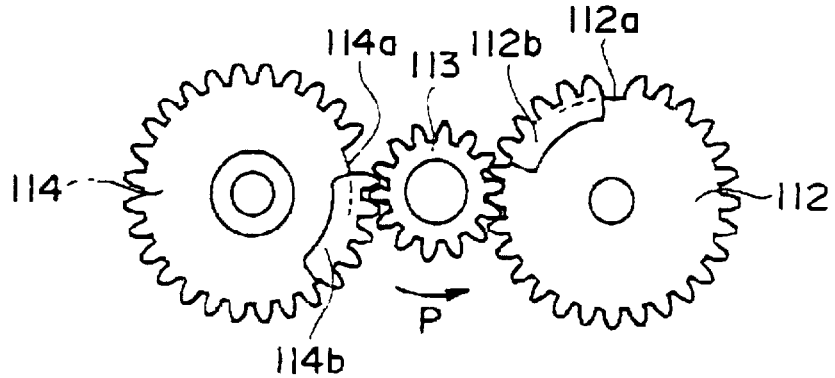
Figure 11:
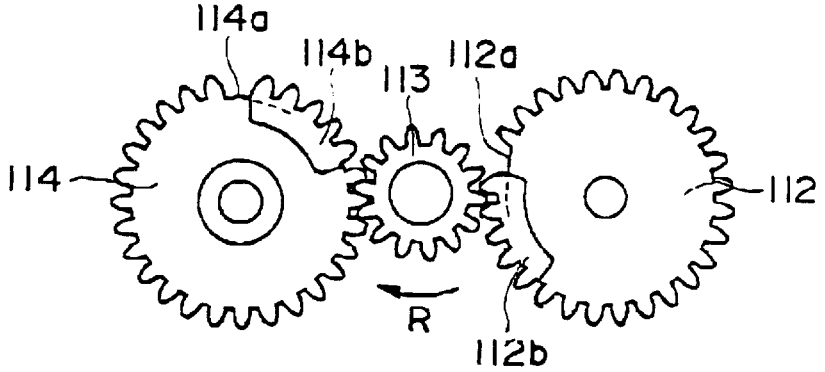

FIG. 11 (*a*)–11 (*c*) illustrate the states of the engagement among the trigger gear 113, pump gear 112, and refill gear 114 during the various processes, as seen from the T direction in FIG. 10.

FIG. 11(*a*) represents a case in which the sheet is conveyed during a normal recording process. The trigger gear 113 is in engagement with the sub-gear 112*b* of the pump gear 112 and the sub-gear 114*b* of the refill gear 114, but is not at a location where it becomes engaged with the LF gear 115. In other words, the trigger gear is not receiving the driving force, and therefore, neither the pump gear 112 nor the refill gear 114 is rotated.

FIG. 11(*b*) represents a case in which the pump driving is operating during the head recovery process. In this case, the trigger gear 113 has been moved by the carrier to a location where it becomes engaged with the LF gear 115 as described before, and as the trigger gear 113 is rotated by the conveyor motor in the direction of an arrow P in the drawing, it rotates the pump gear 112 and refill gear 114 in the clockwise direction in the drawing.

As a result, the pump gear 112 portion facing the LF gear 115 changes from the toothless portion 112*a* to the toothed portion, meshing thereby with the LF gear, and on the other hand, the LF gear 115 still faces the toothless portion 114*b* of the refill gear 114.

Therefore, the pump gear 112 can be rotated back and forth as many times as needed, using the toothed portion. In order to end the head recovery process, the conveyor motor is rotated so as to rotate the trigger gear 113 and LF gear 115 in the direction opposite to the arrow P direction, whereby the state illustrated in FIG. 11(*a*) is restored.

FIG. 11(*c*) represents an ink refilling process, in which the driving force is being transmitted to the ink refilling apparatus. The trigger gear 113 has moved to the position where it becomes engaged with the LF gear 115 as it has in FIG. 11(*b*). As the trigger gear 113 is rotated in the direction of an arrow R in the drawing by the conveyor motor, the pump gear 112 and refill gear 114 are rotated in the counterclockwise direction by the trigger gear 113.

As a result, contrary to the case represented by FIG. 11(*b*), the refill gear 114 portion facing the LF gear 115 changes from the toothless portion 114*a* to the toothed portion, causing the refill gear 114 to mesh with the LF gear 115, and on the other hand, the LF gear 115 still faces the toothless portion 112*b* of the pump gear 112.

The ink refilling operation is carried out in the same manner as the above pump driving operation, and the sequence for ending the ink refilling process is also the same as the head recovery process, except that the rotational direction of the trigger gear is reversed.

Figure 12:
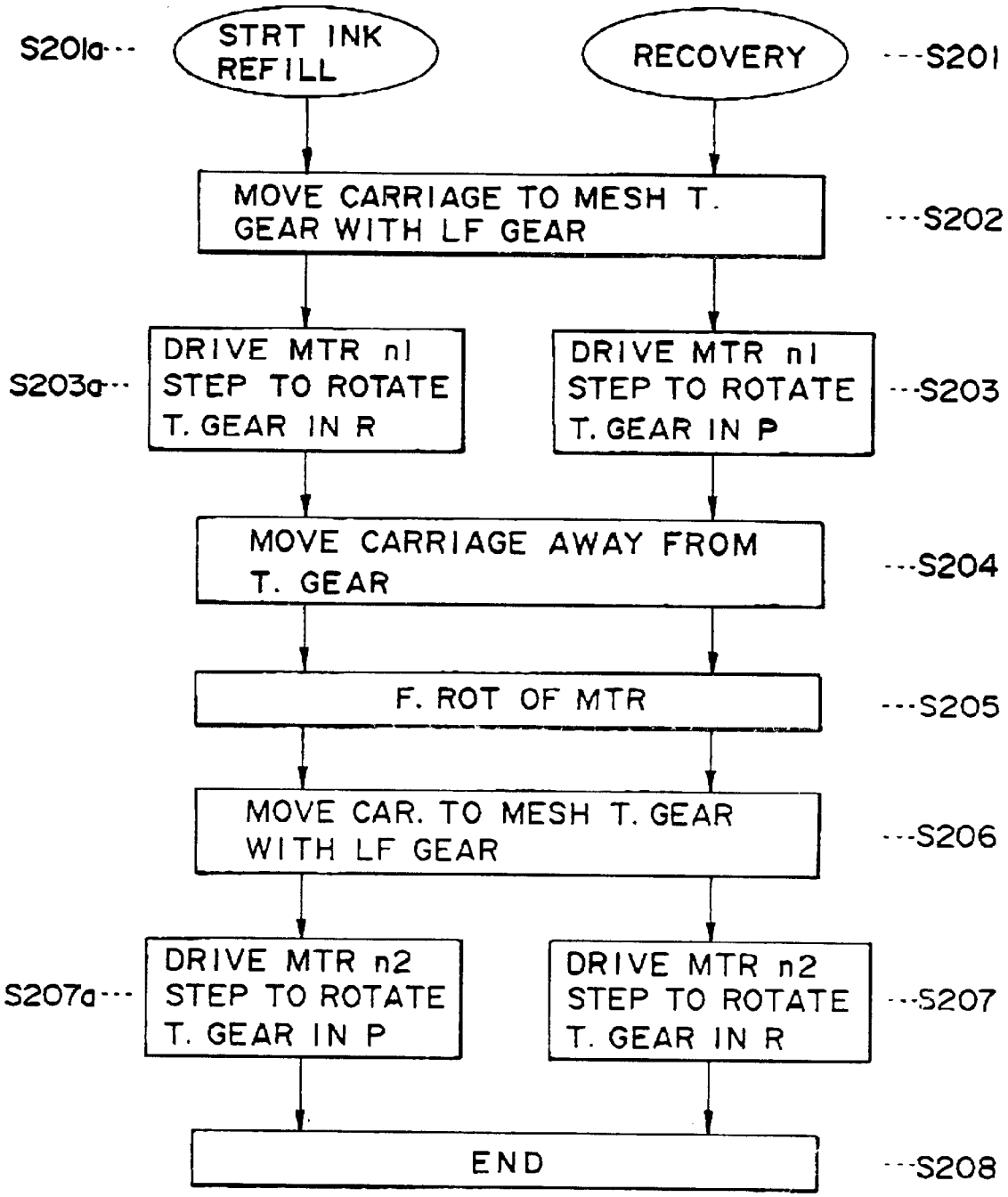
FIG. 12 a flow chart of the operational sequence for the ink refilling system for the fourth example of the embodiment of the present invention.

Below, the operation of this embodiment example will be described with reference to a flow chart given in FIG. 12. In FIG. 12, both the ink filling process and the head recovery process are illustrated.

As the MPU determines that the ink filling process has begun in a step S201*a*, the sequence moves to a step S202, in which the MPU drives the carrier motor through the carrier motor driver 11A, moving the carrier, whereby the moved carrier causes the trigger 113 and LF gear 115 to mesh with each other.

Next, in a step S203*a*, the conveyor motor is driven n1 steps while rotating the trigger gear 113 in the R direction in FIG. 11(*c*).

Then, in a step S204, the carrier motor is driven again so as to disengage the trigger gear 113 and LF gear 115. Next, in a step S205, the conveyor motor is rotated back and forth by the conveyor motor driver, whereby the refill gear 114 is rotated back and forth to drive the pump of the ink refilling apparatus.

After the pump is driven a predetermined number of times, the MPU determines that the end of the ink filling process has come, and the sequence goes to a step S206, in which the carrier is moved again to engage the trigger gear and LF gear, and then, the sequence goes to a step S207*a*.

In the step S207*a*, in response to a command from the MPU, the conveyor motor is driven n2 steps in such a direction that the trigger gear 113 is rotated in the direction (P) opposite to the R direction.

As a result, the gear arrangement is restored to the state illustrated in FIG. 11(*a*), ending the sequence (step S208).

As for the aforementioned difference between the ink filling process and head recovery process, there is only one difference, which is that the rotational direction of the trigger gear is the opposite in step S207 from that in steps S203 and S207.

Therefore, if the gear mechanism is given a modified structure in which a special gear is placed in the gear train for transmitting the driving force from the conveyor motor to the LF gear, in such a manner that it reverses the LF gear rotation when the MPU determines that the ink filling has begun, it is possible to apply a head recovery process program to the ink refilling process.

With the employment of the structure of this embodiment example, it is possible to reduce the number of motors in the ink jet recording apparatus itself. In other words, not only can the recording operation be carried out with a minimum number of motors, but also, the ink refilling system can be operated with a minimum number of the motors.

(OTHER EMBODIMENTS)

In the preceding embodiment examples, the number of dots recorded by the recording head 1 is counted to calculate the ink consumption, which is used to regulate the amount of the ink to be filled. However, detecting means for detecting the ink amount may be provided within the ink container 1*b* of the recording head 1. In this case, the ink filling apparatus and recording apparatus are connected with a cable or the like, so that the ink amount information obtained by the detecting means can be received by the MPU during the ink filling operation, and a control is executed to stop the ink filling operation when the amount of the ink within the ink container reaches a desired level, whereby a proper amount of the ink can be filled.

Further, the ink filling apparatus in the preceding embodiments fill the ink for only one recording head, but the present invention is not limited by these embodiment examples. The ink filling apparatus may be such an apparatus that can accommodate two or more recording heads at one time. Also, the present invention is similarly applicable to a recording head containing inks of different properties (for example, different colors), and to a recording head unit comprising two or more recording heads, each containing ink of different properties.

Further, in the case of the recording head 1 of any of the above embodiment examples, the ejection unit 1*a* and ink container 1*b* are integrated, but instead, the ink container 1*b* may be removably connected to the ejection unit 1*a*, and also, the ink container 1*b* may be disposed at a location different from where the recording head 1 is, and connected to the ejection unit 1*a* with a tube or the like.

Further, when the recording dot count and corresponding ink consumption changes due to the recording conditions such as the internal temperature of the recording apparatus, the amount of the ink to be filled by the ink filling apparatus may be controlled in response to the internal temperature of the recording apparatus detected by the temperature detecting means T provided within the recording apparatus as shown in FIG. 1.

As described above, according to the present invention, the ink filling apparatus is joined with the main structure of the recording apparatus, so that the ink filling apparatus is driven and controlled by the recording apparatus. Therefore, the structure of the ink filling apparatus can be simplified, reducing thereby the production cost, and also, it is easier to automatically fill the ink. Further, since the head cartridge can be repeatedly used, there is an economic effect of reducing the overall recording cost.

While the invention has been described with reference to the structures disclosed herein, it is not confined to the details set forth and this application is intended to cover such modifications or changes as may come within the purposes of the improvements or the scope of the following claims.

What is claimed is:

1. An ink refill kit for refilling ink into an ink jet cartridge which includes a head portion and an ink containing portion which are detachably mountable relative to a carriage in an ink jet apparatus having drive force means for driving ink jet recording, said refill kit comprising:

a mounting portion for mounting said ink let cartridge;

a refilling container for containing ink to be refilled into the ink jet cartridge;

an ink passage which is disposed between the ink containing portion and the mounting portion and through which the ink is refilled into said ink jet cartridge;

ink feeding means for feeding the ink through said ink passage to refill the ink jet cartridge;

driving means for driving said ink feeding means; and a casing for accommodating said mounting portion, said refilling container, said ink passage, said ink feeding means, and said driving means, wherein said casing is detachably mountable relative to the ink jet apparatus, and wherein when said casing is mounted to the ink jet apparatus, said driving means is mechanically engageable with said drive force means of the ink jet apparatus.

2. An ink refill kit according to claim 1, wherein an ink refilling operation is controllable by an ink jet apparatus to which said casing is mounted.

3. An ink refill kit according to claim 1, wherein said ink jet apparatus is switchable between a first state in which the driving of said drive force means is transmitted therefrom to said ink refill kit and a second state in which the driving of said drive force means is not transmitted even when said casing is mounted to said ink jet apparatus and said driving means of said refill kit is engaged with said drive force means of said ink jet apparatus.

4. An ink refill kit according to claim 3, wherein said first state occurs when a drive transmission for recording or recovery operation of said ink jet apparatus is permitted or when a drive transmission exclusively for the refilling operation of said refill kit is permitted, and said second state occurs when a drive transmission for recording or recovery operation is not permitted.

* * * * *

UNITED STATES PATENT AND TRADEMARK OFFICE

CERTIFICATE OF CORRECTION

PATENT NO. : 5,933,174

DATED : August 3, 1999

INVENTOR(S) : Kenji Kawazoe, et al.

It is certified that error appears in the above-identified patent and that said Letters Patent is hereby corrected as shown below:

ON THE TITLE PAGE

At [56], References Cited, Foreign Patent Documents, insert, --0412459A2 2/1991 European Patent Office--;

At [57], Abstract, Abstract line 10, "cartridge;" should read --cartridge,--;

At [57], Abstract, Abstract line 11, "cartridge;" should read --cartridge,-- and At [57], Abstract, Abstract line 12, "connector;" should read --connector,--.

COLUMN 1

Line 37, "into" should read --in-- and

Line 46, "the" should be deleted.

COLUMN 3

Line 41, "to an ink container" should be deleted;

Line 52, "2," should read --2--;

Line 54, "3," should read --3--;

Line 55, "4," should read --4-- and

Line 56, "5," should read --5--.

UNITED STATES PATENT AND TRADEMARK OFFICE

CERTIFICATE OF CORRECTION

PATENT NO. : 5,933,174

DATED : August 3, 1999

INVENTOR(S) : Kenji Kawazoe, et al.

It is certified that error appears in the above-identified patent and that said Letters Patent is hereby corrected as shown below:

COLUMN 5

Line 15, "(home" should read --(a home-- and
Line 19, "cup 22" should read --cap 22--.

COLUMN 6

Line 41, "an" should read --a-- and
Line 57, "is" (2nd occurrence) should be deleted.

COLUMN 9

Line 26, "FIG. 9(a) and 9(b)" should read --FIGS. 9(a) and 9(b)--.

COLUMN 11

Line 3, "FIG. 11 (a)-11 (c)" should read --FIGS. 11(a)-11(c)--.

UNITED STATES PATENT AND TRADEMARK OFFICE

CERTIFICATE OF CORRECTION

PATENT NO. : 5,933,174

DATED : August 3, 1999

INVENTOR(S) : Kenji Kawazoe, et al.

It is certified that error appears in the above-identified patent and that said Letters Patent is hereby corrected as shown below:

COLUMN 12

Line 22, "S207" should read --S207a-- and
Line 36, "the" should be deleted.

COLUMN 13

Line 31, "let" should read --jet--.

Signed and Sealed this

Twenty-seventh Day of June, 2000

*Attest:*

Q. TODD DICKINSON

*Attesting Officer*

*Director of Patents and Trademarks*